US006401395B2

(12) United States Patent
Gabriele

(10) Patent No.: US 6,401,395 B2
(45) Date of Patent: Jun. 11, 2002

(54) PLASTIC LOUVER BODY AND END CAP ASSEMBLY

(75) Inventor: Angelo Gabriele, Woodbridge (CA)

(73) Assignee: VinylBilt Shutter Systems Inc., Concord (CA)

( * ) Notice: Subject to any disclaimer, the term of this patent is extended or adjusted under 35 U.S.C. 154(b) by 0 days.

(21) Appl. No.: 09/263,514

(22) Filed: Mar. 5, 1999

Related U.S. Application Data

(63) Continuation-in-part of application No. 09/001,079, filed on Dec. 31, 1997, now abandoned.

(51) Int. Cl.[7] ..... E06B 7/08
(52) U.S. Cl. ..... 49/403; 49/74.1
(58) Field of Search ..... 49/403, 74.1, 92.1; 160/172, 236, 173; 454/221, 224, 278

(56) References Cited

U.S. PATENT DOCUMENTS 2,623,581 A * 12/1952 Nelson ..... 160/173
2,697,487 A * 12/1954 Nelson ..... 160/173
5,303,507 A * 4/1994 Oille ..... 49/74.1
5,921,028 A * 7/1999 Marocco ..... 49/403

FOREIGN PATENT DOCUMENTS

DK WO90/10777 * 9/1990 ..... 49/403

* cited by examiner

*Primary Examiner*—Daniel P. Stodola
*Assistant Examiner*—Hugh B. Thompson

(57) ABSTRACT

A plastic louver for a shutter comprises a main louver body with end caps which are made separately from the louver body. The louver body before receiving the end caps has open ends, each of which is defined by a surrounding mouth wall and each end cap has an end face which is bordered by an outside edge wall of the end cap. The end caps are fitted into the louver ends such that the outside edge walls of the end caps are positioned interiorly of the louver end mouth walls. This construction gives the plastic louver a one piece wooden look.

3 Claims, 5 Drawing Sheets

PLASTIC LOUVER BODY AND END CAP ASSEMBLY

This application is a continuation-in-part of parent patent application Ser. No. 09/001,079, now abandoned filed Dec. 31, 1997.

FIELD OF THE INVENTION

The present invention relates to the construction of a plastic shutter louver.

BACKGROUND OF THE INVENTION

Louvered shutters are becoming more and more popular as window coverings. When these shutters were first introduced to the marketplace, they were generally made from wood. The main body of the louvers had a solid one piece construction. This construction presented a very neat appearance.

More recently, plastics material has been used to make louvered shutters. When working with plastics, the main body of the louver is cut from a longer generally hollow extrusion leaving the opposite ends of the louver body open. The open ends are then closed with end caps.

In accordance with conventional practice, the outside edge of the end cap rests against the end edge of the main body of the louver leaving end seams which are visible from the front and back faces of the louver. These end seams can be quite noticeable and without extremely accurate quality control can in fact be seen as gaps between the end of the louver and the end caps. These conventional plastic louvers do not therefore leave the neat appearance of the older wooden louvers.

SUMMARY OF THE INVENTION

The present invention provides a plastic louver assembly which eliminates visible seams along the front and back faces of the louver. More particularly, a plastic louver made in accordance with the present invention comprises a main louver body and end caps which are made separately from the louver body. The louver body, before receiving the end caps has open ends, each of which is defined by a surrounding mouth wall and each end cap has an end face which is bordered by an outside edge wall. The end caps are fitted into the louver ends such that the outside edge walls of the end caps are positioned interiorly of the louver end mouth walls.

In a preferred construction, the end face of the cap is flat and flush with the end of the louver body giving the louver a wooden construction appearance while still having the beneficial plastic properties.

With the above assembly, there are no seams or gaps presented from either the back or the front face of the louver between the main louver body and the louver caps.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
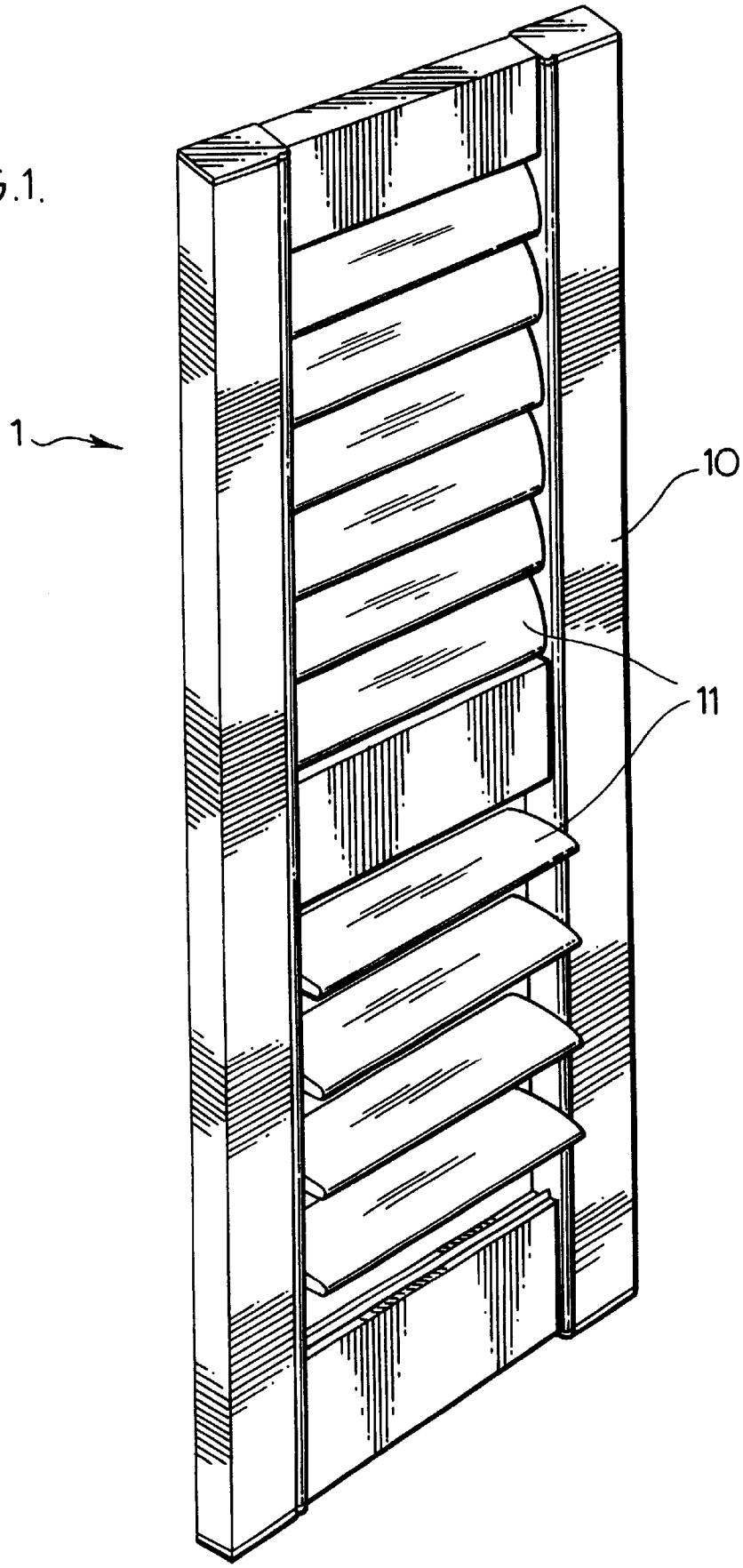
FIG. 1 is a perspective view of a plastic shutter having movable louvers made in accordance with a preferred embodiment of the present invention.

FIG. 1 shows a shutter generally indicated at 1. This shutter comprises a frame 10 with a plurality of louvers 11 secured within the frame. These louvers are pivotal between a closed position as seen in the upper half of the shutter and an open position as seen in the lower half of the shutter.

Figure 2:
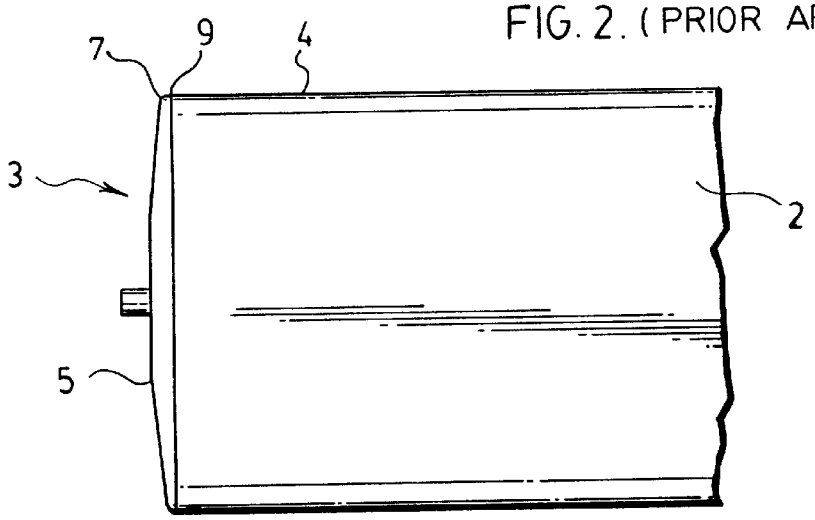
FIG. 2. (PRIOR ART)
FIG. 2 is a front view of the end region of a prior art plastic louver.

FIG. 2 shows the end region of a prior art plastic louver. This louver comprises a main louver body 2 which is fitted with an end cap generally indicated at 3. This end cap has a convex end face 5 bordered by an outside edge wall 7 of the end cap. This outside edge wall aligns with the edge 4 of the main body of the louver. There is a break 9 between the cap and the louver body. In some cases, this break can be a very noticeable gap.

Figure 3:
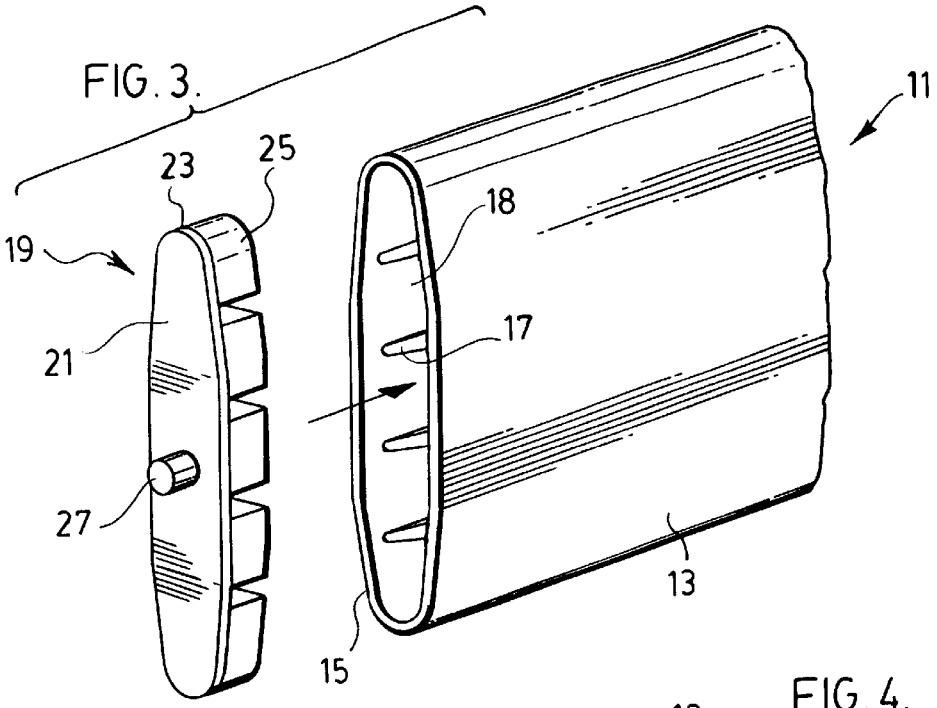
FIG. 3 is an exploded perspective view of an end region of one of the louvers from the shutter of FIG. 1.
Figure 4:
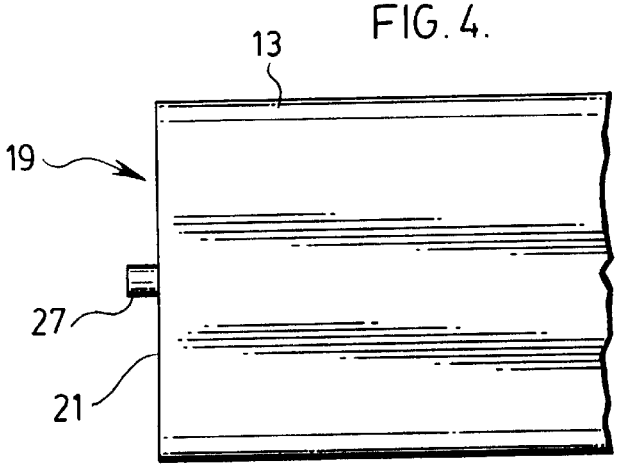
FIG. 4 is a front view of the louver end of FIG. 3 when assembled.

FIG. 3 shows one end of one of the louvers 11 from shutter 1 of FIG. 1. The louver comprises a main louver body 13. This louver body includes a plurality of internal spaced apart ribs 17. Hollow compartments 18 are provided between the ribs 17.

Figure 5:
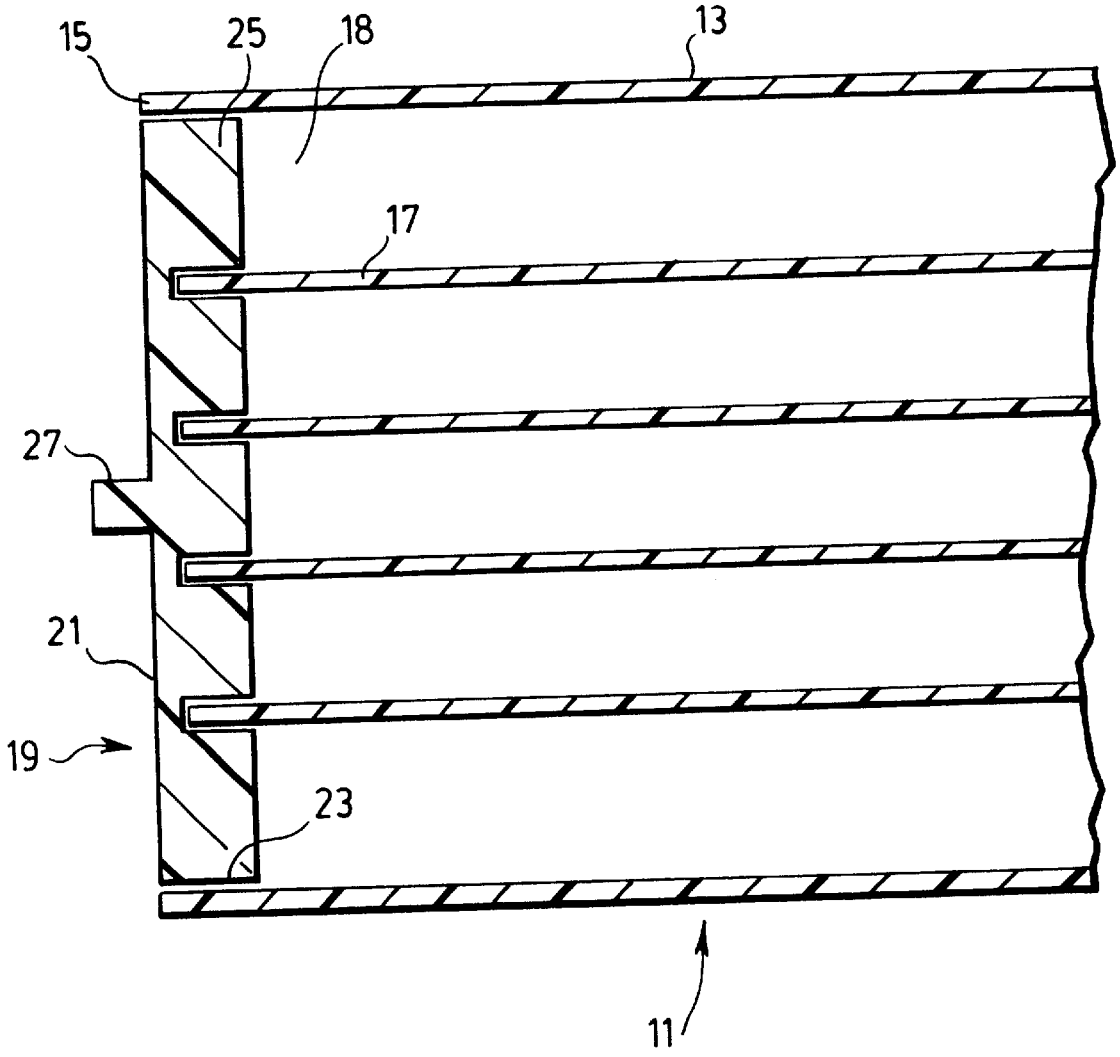
FIG. 5 is a longitudinal sectional view of the louver end of FIG. 4.

As is best seen in FIG. 5 of the drawings, the open end of the main louver body is defined by a surrounding mouth wall 15. The ends of the ribs 17 are recessed interiorly of the main louver body relative to the mouth wall 15.

When louver 11 is fully assembled an end cap, generally indicated at 19, is fitted at each of the open ends of the louver body. Each end cap has a flat end face 21 bordered by an outside edge wall 23. A plurality of plugs 25 are provided on the end cap opposite the flat end face 21. The end cap is completed with a central pivot mount 27. This pivot mount is fitted into the shutter frame to pivotally secure the louver in place.

As is again best shown in FIG. 5, when the end cap is fitted to the louver body, the plugs 25 of the end cap are forced into the hollow compartments 18 in the louver body. The ends of the ribs 17 in the louver body slide into the slots between the end cap plugs. The end cap is now frictionally secured to the louver body. In this fitted or assembled position, the outside edge 23 of the end cap is positioned interiorly of the mouth wall 15 of the louver end. This eliminates any seams which can be seen from either the front or the back face of the louver.

In the preferred embodiment as shown, the end cap is stopped by the louver body ribs in a position where the flat end face 21 of the end cap is level or flush with the end edge of the louver body. This gives the louver a clean wooden look while having the durability and cleanability benefits of a plastic construction.

Figure 6:
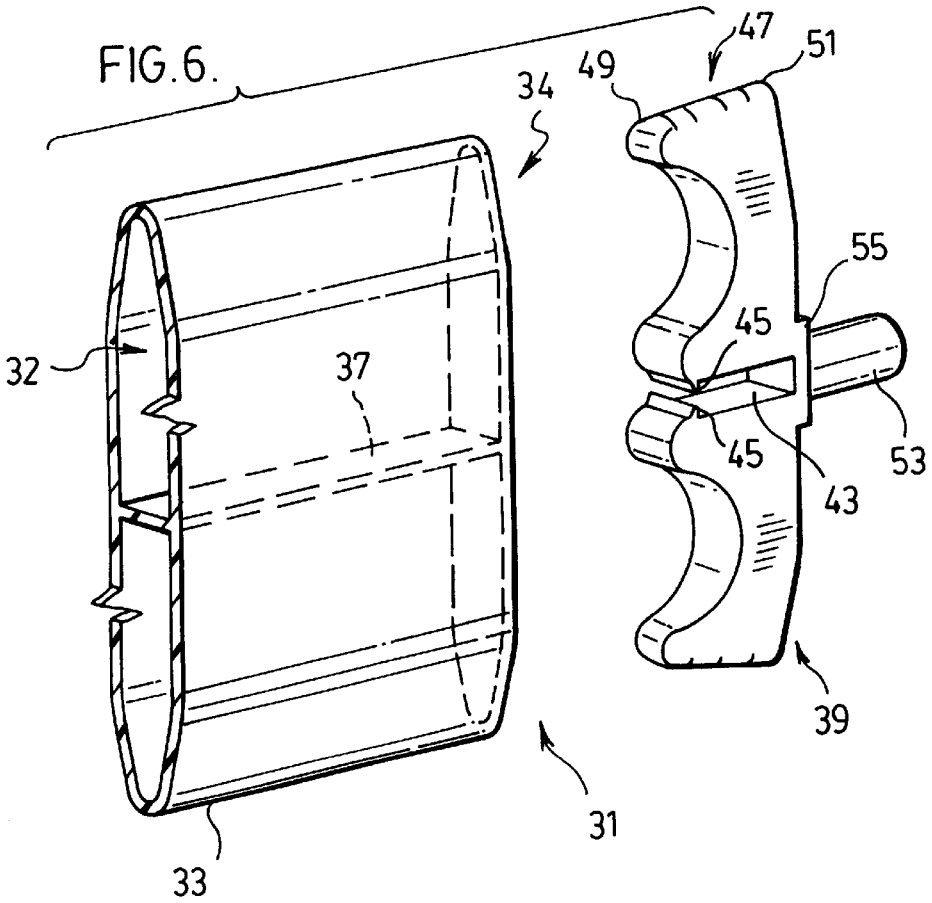
FIG. 6 is an exploded perspective view of a louver end comprising the end of a louver body and an end cap to be fitted to the end of the louver body in accordance with a further preferred embodiment of the present invention.

FIG. 6 shows a louver end assembly generally indicated at 31 according to still a further embodiment of the present invention. In this assembly, an end cap generally indicated at 39 fits into the open end 34 of a louver body generally indicated at 32. The louver body is defined by a continuous elongated oval wall 33. A rib 37 extends interiorly over the full length of and terminates at the open ends of the louver body. Rib 37 provides a fixed stop internally of the louver body for an accurate fitting of the end cap and also assists in locking the end cap with the louver body.

Figure 7:
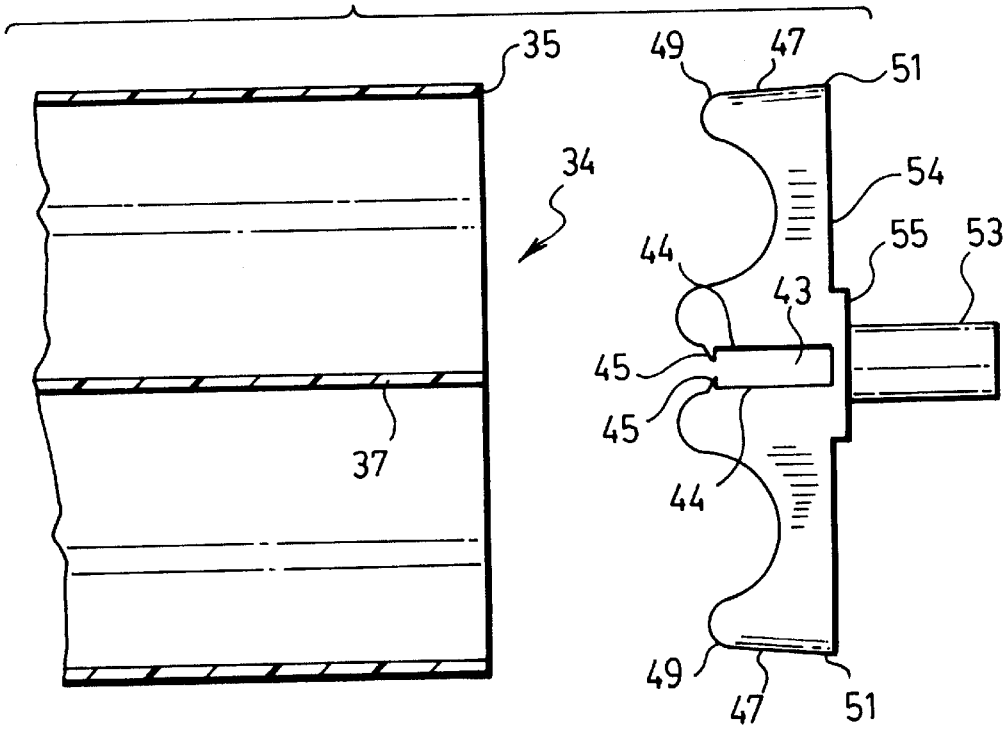
FIG. 7 is a side view of the arrangement of FIG. 6 showing the louver body and end cap in section.
Figure 8:
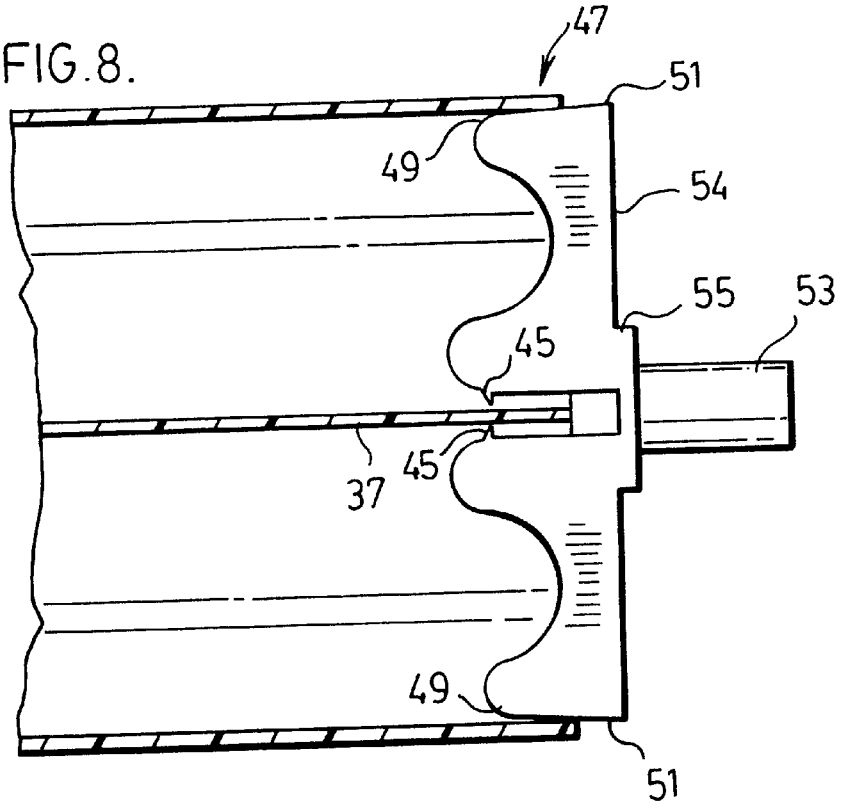
FIGS. 8 and 9 show the fitting of the end cap to the louver body from the arrangement of FIG. 6.
Figure 9:
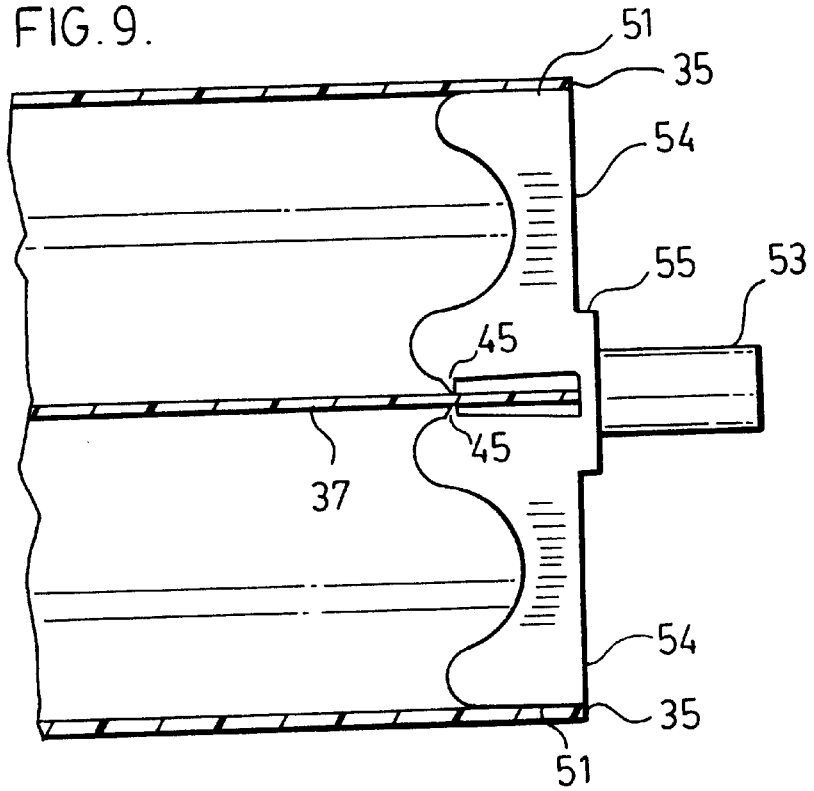

As will be clearly seen in FIGS. 7 through 9, the end cap has a rear or outer surface 54 which is flat except for a centrally raised region 55. This raised region supports a dowel or pin 53 which is used to pivotally mount the louver to the louver frame.

The end cap is provided with a slot 43 to its front or interior surface directly opposite pin 53. As will be seen, both the pin and the slot are located centrally of the end cap which provides a mid point for rotation of the louver and which also provides a central mounting of the end cap to the louver body.

As is well shown in FIG. 7, slot 43 is bordered to its opposite sides by slot walls 44. These slot walls are provided with inwardly directed teeth 45.

The end cap further includes tapered end walls 47 to its opposite ends, such that each end cap has a greater span across the tails 51 than the leading edge 49 of each of the end walls.

The tapering of the end walls as described immediately above produces benefits during the installation of each end cap, the end cap slot 43 is aligned with the louver body rib 37 as shown in FIG. 7. As the leading edges 49 of the end cap end walls enter the louver body, there is no stress placed on the end cap as shown in FIG. 7 and the gap between the teeth 45 of the slot 43 is greater than the thickness of rib 37. This is because, the gap across the leading edges 49 of the opposite end walls 47 of the end cap is slightly less than the interior girth of the louver body which allows an easy initial insertion of the end cap into the louver body as shown in FIG. 8 of the drawings.

However, as the end cap is fully inserted into the louver body, the winder spanning tails 51 of the end cap end walls are forced to wedge against the louver body main wall 33. As a result of this wedging the end cap collapses inwardly at its slot 43 causing the teeth 45 on the slot walls to engage with and to then grip onto the rib 37. Here it should be noted that teeth 45 are themselves provided with a camming front side and a reverse bite shaping. This allows the teeth to be slid along rib 37 as the end caps are pushed into position but resists outward pulling of the end caps. Added to this is the feature that the end caps may be made from a more rigid plastic than the louver body such that teeth 45 have a tendency to bite into and embed themselves in rib 37 making it extremely difficult to pull the end cap out of the louver body.

As will be seen in FIG. 9, once the end cap is fully inserted into the louver body, the end of rib 37 abuts the blind end of slot 45 placing the rear edge 54 of each end cap in direct alignment with the end edge 35 of the louver body. This eliminates any gaps that might otherwise be seen from either the front or the back side of the louver. Furthermore, the extremely tight interfit between the end walls of the end caps with the interior surface of the louver body substantially eliminates any gaps that might otherwise be seen from either end of the louver.

Although various preferred embodiments of the present invention have been described in detail, it will be appreciated by those skilled in the art, that variations may be made without departing from the spirit of the invention or the scope of the appended claims.

The embodiments of the invention in which an exclusive property or privilege is claimed are defined as follows:

1. A plastic louver for a shutter, said louver comprising a main louver body with end caps which are made separately from the louver body, the louver body, before receiving the end caps, having open ends each of which is bordered by a surrounding mouth wall, and each end cap having an end face which is bordered by an outside edge wall of the end cap, each end wall being inserted into the louver end such that the outside edge wall of the end cap is positioned interiorly of the louver end mouth wall, the louver body having a fixed internal stop at each end thereof, and each end cap having a slot which fits over the fixed internal end stop at each end of the louver body, the slot of each end cap being bordered by slot walls, said end caps and said louver body having cooperating surfaces which act against one another as said end caps are fitted into the louver body and which cause said slot walls to deflect against the fixed internal slots of the louver body, the slot walls being provided with teeth that grip on to the fixed internal stops and which secure the end caps with the louver body.

2. A plastic louver as claimed in claim 1, wherein said teeth have a forward cam surface with a reverse bite.

3. A plastic louver as claimed in claim 2, wherein said teeth are harder than and embedded into said fixed internal stops.

* * * * *